US005080612A

United States Patent [19]

Salomon

[11] Patent Number: 5,080,612

[45] Date of Patent: Jan. 14, 1992

[54] ELECTRICAL APPLIANCE

[75] Inventor: Thomas Salomon, Schloss Holte, Fed. Rep. of Germany

[73] Assignee: Melitta-Werke Bentz & Sohn, Minden, Fed. Rep. of Germany

[21] Appl. No.: 537,812

[22] Filed: Jun. 14, 1990

[30] Foreign Application Priority Data

Jun. 23, 1989 [DE] Fed. Rep. of Germany ..... 3920583

[51] Int. Cl.[5] ..... H01R 13/60

[52] U.S. Cl. ..... 439/568

[58] Field of Search ..... 439/369, 527, 568; 219/297

[56] References Cited

U.S. PATENT DOCUMENTS 1,606,829 11/1926 Evans ..... 439/527 X
2,672,594 3/1959 Morton ..... 439/369
4,784,616 11/1988 Zimmermann ..... 439/568

FOREIGN PATENT DOCUMENTS

68067/74 10/1975 Australia .
0015759 9/1980 European Pat. Off. .
0075070 3/1983 European Pat. Off. .
8806072 8/1988 Fed. Rep. of Germany .
2367359 5/1978 France .
2574999 6/1986 France .

*Primary Examiner*—Eugene F. Desmond
*Attorney, Agent, or Firm*—Spencer & Frank

[57] ABSTRACT

An improved electrical appliance includes a housing defining an inner space, a current supply cable having a plurality of conductors which extends into the housing, first contact elements constituting appliance terminals which are supported in the housing and an electrical connecting device accommodated in the inner space which electrically connects the current supply cable with the first contact elements. The electrical connecting device is formed of a solid insulating body having an end face, a plurality of second contact elements, constituting cable terminals, received in the solid insulating body and having end portions projecting outwardly from the end face of the body and an insulating terminal plate fixed in the inner space of the housing and carrying the first contact elements. The conductors of the supply cable are electrically connected to respective second contact elements. The first contact elements are in electrical contact with respective end portions of second contact elements.

11 Claims, 1 Drawing Sheet

FIG. 1
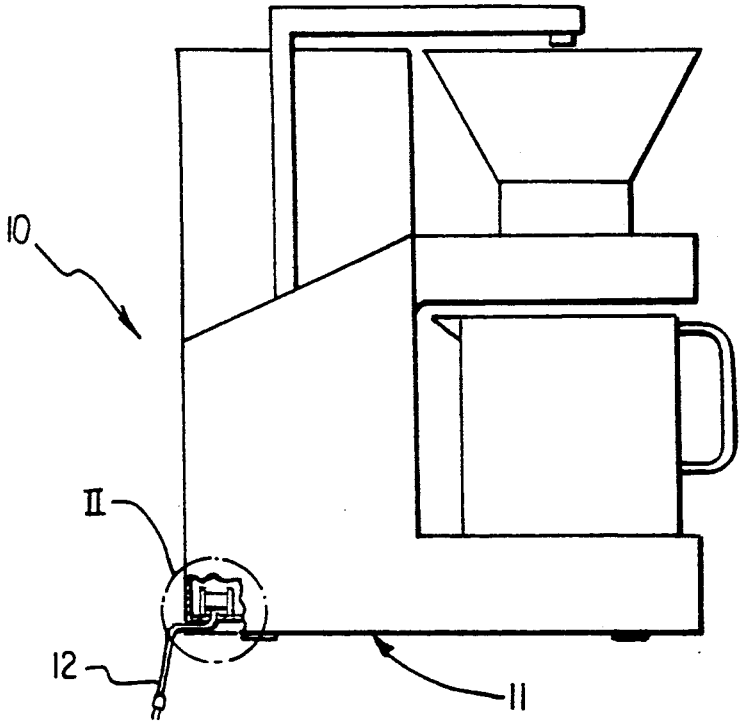
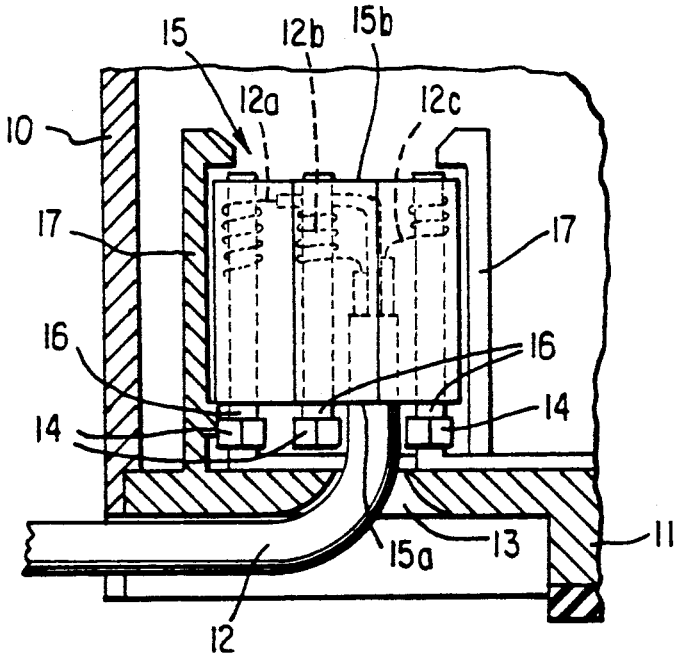
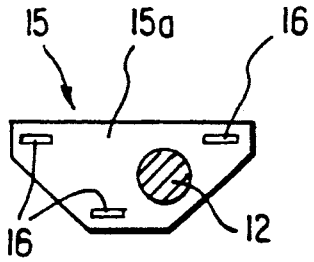
FIG. 3
FIG. 2

ELECTRICAL APPLIANCE

CROSS-REFERENCE TO RELATED APPLICATION

The present disclosure relates to the subject matter disclosed in the Federal Republic of Germany Application No. 39 20 583.5 filed June 23rd, 1989, the entire specification of which is incorporated herein by reference.

BACKGROUND OF THE INVENTION

The present invention relates to an electrical appliance, particularly an electrical household appliance, including an essentially closed housing and a current supply cable formed of a plurality of conductors and connected to current consuming components of the appliance.

In prior art electrical appliances of this type, the conductor ends of the current supply cable on the appliance side are clamped to contacts by means of screws. In other prior art embodiments, the conductors are soldered on, pressure fitted with and pushed in, or hammered on to the contacts. These types of fastenings are very labor intensive.

Moreover, with these fastenings, prior art current supply cables must be prevented from transferring traction and pressure forces to the clamped or soldered connection. For this purpose, it is known to clamp the cable on by means of a clamping ring or circular clip formed of two half shells, or to fix the cable in place with a labyrinth clamp which even further increases labor costs. The fastening connection points usually lie within the housing of the appliance. Thus, the current supply cable is installed firmly and is rigidly connected to the electrical appliance in which it is held captive.

SUMMARY OF THE INVENTION

It is an object of the present invention to provide an electrical appliance of the above-outlined type in which the installation of the current supply cable is substantially simplified.

It is a further object to provide an electrical appliance which can be assembled without special manipulation or equipment for the current supply cable.

The present invention accomplishes the above objects by providing a solid insulating body which is disposed within the interior defined by the housing of the appliance. A number of contact elements corresponding to the number of conductors in the current supply cable to be attached to the housing are disposed in the insulating body. The contact elements are electrically connected to respective conductors of the current supply cable and project beyond that end face of the insulating body through which the current supply cable enters the insulating body. A contact plate associated with the insulating body is fixed to the interior of the appliance and is provided with contact means which are in electrically conductive engagement with the contact elements of the insulating body.

The conductors of the current supply cable according to the invention are composed of plastic sheathed copper wires which, for connection with the contact elements of the insulating body, are exposed over a predetermined length at their ends to be attached to the appliance. An appropriate manufacturing process for the insulating body anchors not only the contact elements but also the conductors firmly within the insulating body. Thus, the electrical connection between a conductor and the contact element of the invention can no longer be released after the manufacturing process.

A particular advantage of the invention is that the contact elements project beyond the end face where the current supply cable enters the insulating body. With this configuration, a force pulling on a portion of the current supply cable extending outside the appliance housing causes the insulating body to be pulled against the contact plate. The contact plate serves as an abutment member, thus making separation impossible.

In addition, the structural arrangement of the insulating body and the contact plate causes the traction force to be transferred to the housing of the electrical appliance which can absorb the force without damaging the appliance. Consequently there is no stress on the connection between the conductors and the contact elements. As a result, the electrical appliance according to the present invention no longer requires the customary clamping of the current supply cable which was previously considered necessary in the prior art. Further, electrical appliances are mass produced and conventially are assembled wholly or in part by means of so-called assembly robots. The insulating body of the present invention can easily be designed for such an assembly as described below.

Manufacture of the insulating body is particularly simple if the insulating body is produced by a plastic injection molding process. Using such a process, the contact elements associated with the insulating body are inserted in the proper position in an appropriately designed mold or tool and the exposed ends of the cable conductors are connected to the contact elements. The current supply cable thus projects into the space defined by the contact elements. After the plastic injected into the tool has hardened, a one-piece connector is obtained which is composed of the current supply cable and the insulating body and is ready for electrical connection. Moreover, as a result of the above assembly, the position of the projecting ends of the contact elements relative to one another corresponds with high precision to the desired dimensions so that assembly difficulties due to manufacturing inaccuracies are avoided.

In order to prevent the plug-in connection between the insulating body and the contact plate from coming loose over the course of time, a further feature of the invention provides that detent means are shaped onto the interior of the housing or to a removable bottom so as to grip and hold the insulating body in the appliance and thus provides additional protection.

BRIEF DESCRIPTION OF THE DRAWINGS

FIG. 1 is a schematic, partially sectional side elevational view of an electrical appliance incorporating the present invention.

FIG. 2 is an enlarged detailed view of insert II in FIG. 1 showing the connection of the current supply cable according to a preferred embodiment of the invention.

FIG. 3 is an end view of the insulating body looking at the entrance side of the current supply cable.

DESCRIPTION OF THE PREFERRED EMBODIMENT

FIG. 1 shows a household coffee maker which is generally known and will therefore not be described in detail. It has a plastic housing 10 and a bottom 11 that can be removed only by means of a special tool. Bottom 11 is fastened in a conventional manner to the corresponding edges of housing 10. In the illustrated embodiment, the electrical connection between a current supply cable 12 and the non-illustrated current consuming components of the electrical appliance is provided in a corner formed from a side wall of housing 10 and bottom 11 of the appliance. Bottom 11 is provided with an opening 13 through which current supply cable 12 is brought to the interior of housing 10.

Household appliances are customarily operated at voltages of 110 and 220 V. This requires either a two or three-conductor current supply cable. Three contact sockets (appliance terminals) 14 are disposed in the interior of housing 10 at bottom 11 and serve as contact means. By way of cables (not shown), these contact means are electrically connected with the current consuming components of the appliance.

As shown in FIGS. 2 and 3, insulating body 15 is provided with three contact elements in the form of contact blades 16 or contact pins which extend over the entire height of the body. These contact elements project beyond a lower end face 15*a* of insulating body 15 which faces bottom 11 and to which current supply cable 12 is attached. Contact elements or blades 16 extend beyond lower face 15*a* so that they can be plugged into contact sockets 14. For manufacturing and testing reasons, contact blades 16 can also project beyond the parallel upper face 15*b* of insulating body 15. This projection is of no significance for normal household use of the appliance.

The end of current supply cable 12 lies within insulating body 15. Thus, current supply cable 12 as well as its conductors are firmly anchored in insulating body 15. Each end of conductors 12*a*, 12*b* and 12*c* of current supply cable 12 is connected to a respective contact blade 16 (cable terminal) embedded within insulating body 15. In a preferred embodiment of the invention, the insulating body is manufactured from a plastic thus, rendering a short circuit of the electrical connection impossible.

In the present embodiment, two detent means in the form of hooks 17 extend behind the upper face 15*b* of insulating body 15 to hold the insulating body within the interior of housing 10. Detent hooks 17 project at right angles from bottom 11 and may be of unitary construction with bottom 11. In contrast to the illustrated embodiment, detent tabs may also be employed which engage detent recesses provided in sides of insulating body 15.

As shown in FIG. 3, the cross-section of insulating body 15 may have the shape of a trapezoid-like, irregular hexagon. Other cross-sectional shapes are conceivable, as the shape would depend on the number of conductors in current supply cable 12 and on the number of contact blades 16.

Contact sockets 14 are part of an insulating terminal plate 19 which may have any desired shape. In the illustrated embodiment, the plate 19 is fastened to the interior of bottom 11. The arrangement of the detent means on bottom 11 of the appliance has the great advantage that the assembly of the contact elements or blades 16 with contact sockets 14 ca be effected before bottom 11 is fastened to corresponding edges of housing 10. Depending on the type of electrical appliance involved, however, it may also be an advantage if the detent means and the contact plate are fastened to an interior face of a side wall or a cover of the appliance housing.

Further, as shown in FIG. 2, contact blades 16 of insulating body 15 would be pulled firmly into contact sockets 14 if forces acting on current supply cable 12 pull on the portion of the cable outside the housing. Thus, the structure of the instant invention provides a stronger electrical connection when such a force is applied. Further, since current supply cable 12 is firmly embedded in insulating body 15 and its conductors are attached over a relatively great length (compared to prior art devices), no forces are transferred to the connection between the conductors of current supply cable 12 and contact blades 16.

It will be understood that the above description of the present invention is susceptible to various modifications, changes and adaptations, and the same are intended to be comprehended within the meaning and range of equivalents of the appended claims.

I claim:

1. In an electrical appliance including a housing defining an inner space, a current supply cable having a plurality of conductors and extending into the housing, first contact elements constituting appliance terminals supported in the housing and electrical connecting means for electrically connecting the current supply cable with the first contact elements; the improvement wherein said electrical connecting means comprises:

(a) a solid insulating body accommodated in said inner space and having an end face, said current supply cable having an end portion extending into said solid insulating body through said end face;

(b) a plurality of second contact elements, constituting cable terminals, received in said solid insulating body and having end portions projecting outwardly from said end face; said conductors being electrically connected to respective said second contact elements; said first contact elements being in electrical contact with respective said end portions of said second contact elements and (c) an insulating terminal plate fixed in said inner space of the housing and carrying said first contact elements.

2. An electrical appliance as defined in claim 1, wherein the insulating body is an injection-molded plastic block.

3. An electrical appliance as defined in claim 2, wherein a cross section of the insulating body taken parallel to said end face has an irregular polygonal shape.

4. An electrical appliance as defined in claim 3, wherein the polygonal shape is hexagonal.

5. An electrical appliance as defined in claim 3, wherein the polygonal shape is trapezoidal.

6. An electrical appliance as defined in claim 1, further comprising detent means for holding the insulating body within the housing, said detent means projecting into said inner space of said housing.

7. An electrical appliance as defined in claim 6, wherein said housing comprises a removable bottom, said detent means being secured to the removable bottom.

8. An electrical appliance as defined in claim 6, said detent means being secured to an inner face of a side wall of said housing.

9. An electrical appliance as defined in claim 1, wherein said first contact elements are sockets and said second contact elements are prongs.

10. An electrical appliance as defined in claim 9, wherein said prongs are contact blades.

11. An electrical appliance as defined in claim 9, wherein said prongs are contact pins.

* * * * *